US011102861B1

(12) United States Patent
Zolotykh et al.

(10) Patent No.: US 11,102,861 B1
(45) Date of Patent: Aug. 24, 2021

(54) LONG LIFE LIGHT EMITTING DIODE (LED) LUMINAIRES

(71) Applicants: Valeriy Zolotykh, Boston, MA (US); Ravidasa Hegde, Andover, MA (US); Anil Jeswani, Acton, MA (US)

(72) Inventors: Valeriy Zolotykh, Boston, MA (US); Ravidasa Hegde, Andover, MA (US); Anil Jeswani, Acton, MA (US)

(73) Assignee: LEDVANCE LLC, Wilmington, MA (US)

( * ) Notice: Subject to any disclaimer, the term of this patent is extended or adjusted under 35 U.S.C. 154(b) by 0 days.

(21) Appl. No.: 16/880,310

(22) Filed: May 21, 2020

(51) Int. Cl.

| | |
|---|---|
| ***H05B 45/00*** | (2020.01) |
| ***H05B 45/10*** | (2020.01) |
| ***H05B 47/165*** | (2020.01) |
| ***H05B 47/19*** | (2020.01) |
| ***H05B 45/40*** | (2020.01) |

(52) U.S. Cl.
CPC ..... *H05B 45/10* (2020.01); *H05B 45/40* (2020.01); *H05B 47/165* (2020.01); *H05B 47/19* (2020.01)

(58) Field of Classification Search
CPC ..... H05B 45/10; H05B 45/19; H05B 45/40; H05B 45/165
See application file for complete search history.

(56) References Cited

U.S. PATENT DOCUMENTS

| | | | | |
|---|---|---|---|---|
| 4,376,909 | A * | 3/1983 | Tagami | B60Q 1/1423 315/82 |
| 5,923,549 | A * | 7/1999 | Kobayashi | H02M 7/4807 363/65 |
| 9,615,420 | B2 * | 4/2017 | Miskin | H05B 45/30 |
| 9,912,143 | B1 * | 3/2018 | Hogan | H05B 45/52 |
| 10,808,900 | B1 * | 10/2020 | Timinger | F21S 41/663 |
| 2013/0162148 | A1 * | 6/2013 | Huang | H05B 45/00 315/158 |
| 2014/0217907 | A1 * | 8/2014 | Harris | H05B 45/44 315/186 |
| 2016/0315499 | A1 * | 10/2016 | Pope | H05B 45/10 |
| 2018/0063913 | A1 * | 3/2018 | Kang | H05B 47/185 |

* cited by examiner

*Primary Examiner* — Kurtis R Bahr
(74) *Attorney, Agent, or Firm* — Tutunjian & Bitetto PC

(57) ABSTRACT

A driver electronics is provided for powering a light engine including light emitting diodes (LEDs). The driver electronics arrangement includes at least two drivers that alternate power to a light engine. By alternating between the two drivers to power the light engine, the service life of the luminaire is increased. In one embodiment, the driver electronics includes at least two drivers, a light engine and a control relay block. The control relay block controls the at least two drivers so that only one of the drivers is powering the light engine at a time.

18 Claims, 7 Drawing Sheets

LONG LIFE LIGHT EMITTING DIODE (LED) LUMINAIRES

TECHNICAL FIELD

The present disclosure generally relates to lighting, and more particularly to lighting that employs light emitting diodes (LEDs).

BACKGROUND

The light-emitting diode (LED) is one of the most common lighting appliances currently available on the market. In comparison with the traditional incandescent light bulbs, LED lamps and luminaires have higher luminous efficiency and power-saving features. Luminaires use electronic drivers to provide the required voltage and current to the light emitting diodes (LEDs) used in the Luminaires.

SUMMARY

In one aspect, a driver electronics arrangement is provided for powering a light engine including light emitting diodes (LEDs) in a luminaire/lamp. The driver electronics arrangement includes at least two drivers that alternate power to a light engine. By alternating power driving requirements between the two drivers to power the light engine, the service life of the luminaire/lamp is increased. In one embodiment, the driver electronics includes at least two drivers and a control relay block. The control relay block controls the at least two drivers output to the light engine so that only one of the drivers is powering the light engine at a time. The control relay block controls the output of the at least two drivers such that only one driver is powering the light engine at any given time.

In another aspect, a luminaire is provided that includes a driver arrangement having at least two drivers. The use of the drivers to power the light engine is alternated so that only one of the drivers is functioning to power the light engine at a time. By alternating between the two drivers to power the light engine, the service life of the luminaire/lamp is increased. In one embodiment, the luminaire includes driver electronics includes at least two drivers, a light engine and a control relay block. The control relay block controls the at least two drivers output to the light engine so that only one of the drivers is powering the light engine at a time. The control relay block controls the output of the at least two drivers such that only one driver is powering the light engine at any given time.

In yet another aspect, an illumination method is provided that extends the life of a luminaire by providing at least two drivers and alternating the drivers to power the light engine of the lamp one driver at a time. This method shares the powering load between the two drivers to extend the life of the luminaire including the drivers. In one embodiment, the method includes connecting at least two drivers to a light engine through a relay control block and switching between a first of the at least two drivers to a second of the at least two drivers. In some embodiments, switching between the two drivers is controlled by the relay control block, and the switching between the two drivers is at a time interval that provides that only one driver powers the light engine at a time.

BRIEF DESCRIPTION OF THE DRAWINGS

The following description will provide details of embodiments with reference to the following figures wherein.

DETAILED DESCRIPTION

Figure 1:
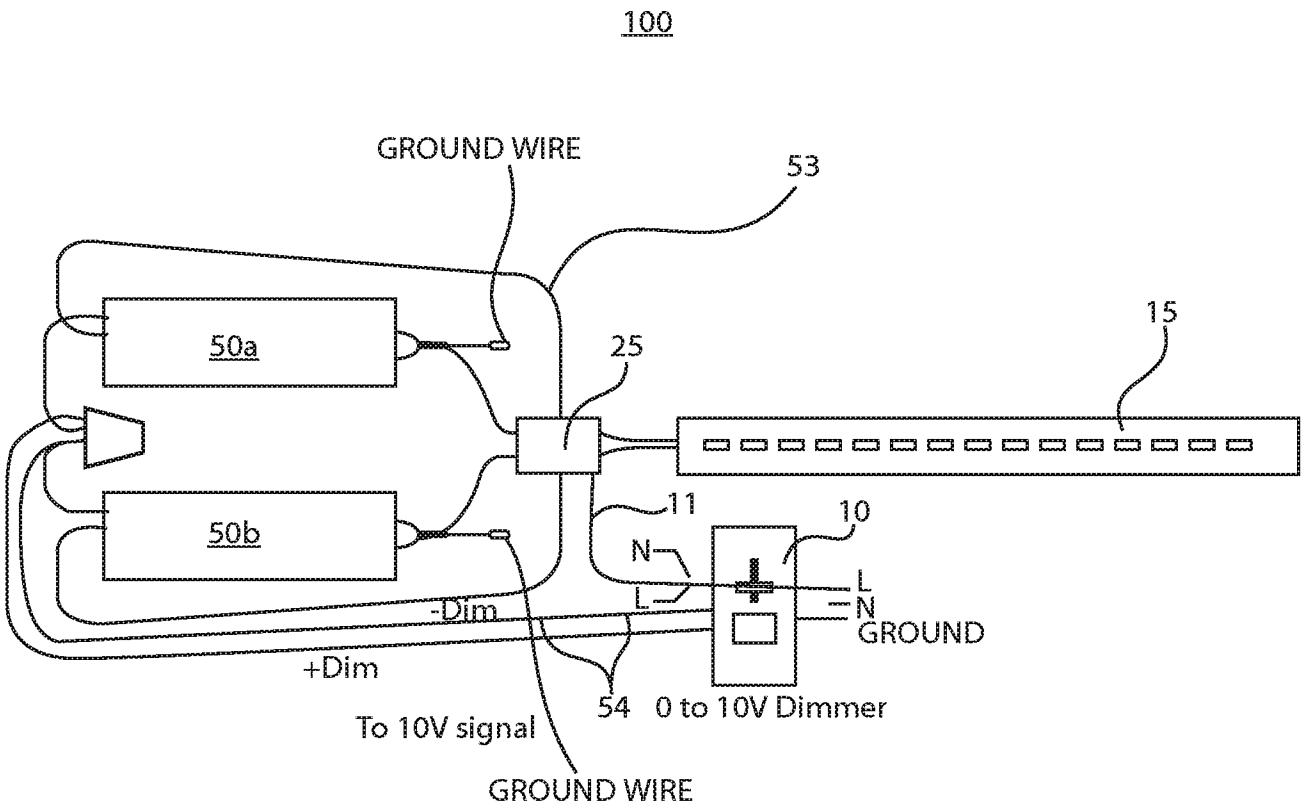
FIG. 1 is a block diagram for the driver electronics of a luminaire, in which the driver electronics including two drivers each, and each driver has a filter design that limits the percent flicker to be on the order of 30% or lower, in accordance with one embodiment of the present disclosure.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment.

The structures, methods and lighting systems described herein provide designs for light fixtures having driver electronics with an increased lifetime when compared to prior designs. As used herein, the term lamp and luminaire may be used to describe the lighting structures depicted in FIGS. 1-7. Luminaires/lamps use electronic drivers to provide the required voltage and current to the light emitting diodes (LED) of the luminaire. A light emitting diode is a form of solid state light emitter. The term "solid state" refers to light emitted by solid-state electroluminescence, as opposed to incandescent bulbs (which use thermal radiation) or fluorescent tubes, which use a low pressure Hg discharge. In a broad sense, a light emitting diode (LED) is a semiconductor device that emits visible light when an electric current passes through it. Although light emitting diodes (LEDs) themselves can last 15 years or more, the maximum life of most electronic drivers used in luminaires is generally limited by the electrolytic capacitors that are used in them when operating under normal conditions. An electrolytic capacitor (occasionally abbreviated e-cap) is a polarized capacitor whose anode or positive plate is made of a metal that forms an insulating oxide layer through anodization. This oxide layer acts as the dielectric of the capacitor. Most manufacturers specify a lifetime for light structures, e.g., luminaires, containing these types of capacitors that is equal to 10 years of less.

There are applications for luminaires including light emitting diodes (LEDs), such as high bay fixtures, where the cost of maintenance and replacement of the luminaires, or their components is very high and requires very high life-time of 15 years or more. In view of these applications, a need exists for an electronic driver scheme that can assure a lifetime of 15 years or more. There are direct alternating current (AC) type LED driver schemes in the market that claim lifetimes on the order of 15 years, which eliminate the use of the above described electrolytic capacitors. However, it has been determined that these driver electronics that do not include the electrolytic capacitors having a very high percent flicker, which can be on the order of 100%. Additionally, driver electronics that do not include electrolytic capacitors and have a high lifetime are expensive structures, which limit their application.

The alternating current (AC) direct type light emitting diode (LED) driving schemes have a limitation that the driver needs to be matched to input voltage, and the light emitting diode (LED) light engine string arrangement. These drivers become point designs and cannot be used for multiple inputs, such as 120V and 277V, using one, i.e., a single driver.

The driver electronics scheme that is described herein eliminates the issue of very high flicker percentage in high lifetime electronic drivers. Further, the driver electronics scheme of the present disclosure is a cost effective solution for use in luminaires having a lifetime greater than 10 year, e.g., greater than 15 years. In some embodiments, by using two drivers and switching the operation between the two of them, the drivers are effectively used for about half of the life of the luminaire. It has been determined that it is the life of the driver that primarily determines the life of the luminaire. By using two drivers, in which each of the drivers has a lifetime of 10 years, the lifetime of the luminaire including the two drivers has a lifetime that is clearly greater than 15 years.

The term "ON" as used herein denotes that a driver is supplying current/voltage that causes the light engine to emit light. The term "OFF" as used herein denotes that a driver is not supplying current/voltage that causes a light engine to emit light.

Further, as will be described in greater detail below, the electronics designs employed here include filter designs that limit the percent flicker. For example, the percent flicker of the electronic driver designs provided herein may be on the order of 30% or lower. In some examples, the electronic driver designs provided herein produce a percent flicker of 10% or less. Various embodiments of the disclosed lamp are now presented with further detail with reference to FIGS. 1-7.

FIG. 1 is a block diagram for the driver electronics 100 of a luminaire, in which the driver electronics 100 including two drivers 50*a*, 50*b*, and each driver 50*a*, 50*b* having a filter design that limits the percent flicker to be on the order of 30% or lower, in accordance with one embodiment of the present disclosure. In some examples, each of the drivers 50*a*, 50*b* can have a service life of approximately 10 years. A percent flicker of 30% or less is a substantial reduction in percent flicker when compared to long lifespan driver electronics devices that do not include electrolytic capacitors and have a percent flicker on the order of 100%. The percent flicker is directly proportional to ripple current of the driver. The driver electronics 100 provide an output current that is continuous and hence has 25% to 50% less peak current for the same power level. The output current provided by the driver electronics 100 of the present disclosure can reduce the light emitting diode (LED) current requirement between 25% to 50% when compared to prior designs. This is because of the lower ripple current in the driver electronics 100 compared to long lifespan driver electronics devices that do not include electrolytic capacitors. The reduction in LED peak current requirements reduces the light emitting diode (LED) costs. The driver electronics 100 disclosed herein, such as those depicted in FIG. 1, enables multiple input drivers (50*a*, 50*b*), e.g., 120V/277V and 347V/480V. This can reduce the requirements for the number of different light engine models and inventory.

The scheme for the driver electronics 100 depicted in FIG. 1 includes two programmable drivers 50*a*, 50*b* to provide the required voltage and current to the light emitting diode (LED) light engine. In the embodiment that is depicted in FIG. 1, only one of the two drivers 50*a*, 50*b* will be powered, i.e., "ON", at a time. By only one of the two drivers 50*a*, 50*b* being on, it is means that the other driver is not powered, i.e., "OFF". For example, when the first driver 50*a* is powered, i.e., "ON", the second driver 50*b* is not powered, i.e., "OFF". The scheme for the driver electronics 100 also includes relay control and communications block 25. The relay control and communications block 25 is provided to receive signal from a dimmer 10, in which in response to the signal received from the dimmer 10, the two programmable drivers 50*a*, 50*b* energize the light engine 15. In one example, each of the drivers, e.g., the first driver 50*a*, and the second driver 50*b*, may have a lifetime of 10 years. It is noted that this is only one example of a service life for the drivers 50*a*, 50*b*. Any service life rating can be selected for the drivers 50*a*, 50*b* being used in the driver electronics. The service life for the drivers 50*a*, 50*b* can be selected based on application.

Figure 2:
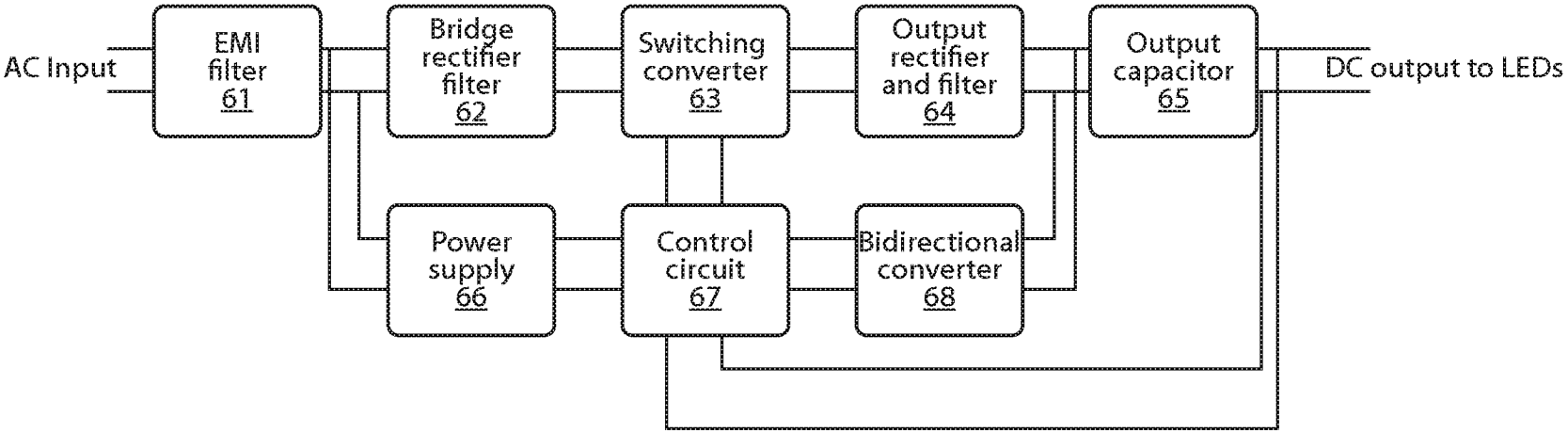
FIG. 2 is a block diagram of the driver electronics for the driver arrangements depicted in FIG. 1, in accordance with one embodiment of the present disclosure.

FIG. 2 is a block diagram of a driver 50*a*, 50*b* employed within the driver electronics arrangement that is depicted in FIG. 1. Each of the drivers 50*a*, 50*b* may include an EMI filter 61, a bridge rectifier and filter 62, a switching converter 63, an output rectifier and filter 64, an output capacitor 65 (i.e., film or ceramic capacitor), a power supply 66, a control circuit 67 and a bidirectional converter 68.

EMI Filter 61 filters out any conducted radio frequency emissions going back to the mains input and potentially causing electromagnetic interference to other electronic devices and equipment connected on the same input line. This filter helps meet the requirements of the FCC emissions standards.

The bridge rectifier and filter 62 converts the Alternating Current input to a Direct current output using a bridge rectifier. The resultant output is pulsating DC. The filter in this block is designed to filter out the switching frequency component of the current and thus keep the input current to primarily the line frequency component of 60 Hz.

Switching converter block 63 essentially uses high frequency switching topology such as flyback topology and convert the input voltage level to match with the required Light engine voltage level. Other switching topologies such as buck boost may also be used.

Output rectifier and filter 64 is used to rectify the high frequency switching voltage from the switching converter to a pulsating DC.

Output capacitor 65 is used to smoothen the output voltage and reduce the ripple content on the output.

The power supply 66 is used to provide the required low voltage power supply for the operation of switching controller IC and the other electronic devices and components in the driver.

Control circuit 67 controls the switching converter by driving the switching elements with the right timing, provide required protection against faults on the output such as short circuit, regulate the output current to the set value and provide the dimming control.

Most LED drivers have electrolytic capacitors to reduce the low frequency output ripple that is caused by the line frequency component. To filter out such low frequency component, a high capacitance for the electrolytic capacitor is employed, which can range from being on the order of tens of micro farads to hundreds of micro farads. Such high value of capacitance can be only realistically realized by electrolytic capacitors. These electrolytic capacitors are the lifetime limiting components in the LED drivers. The lifetime of luminaires including these electrolytic capacitors can be enhanced by eliminating these electrolytic capacitors, such as in the driver design that is depicted in FIG. 2.

The LED driver design depicted in FIG. 2 eliminates the use of electrolytic capacitor, by employing a film or ceramic capacitor (output capacitor 65) in combination with the bidirectional converter 68. Electrolytic capacitors consist of two small sheets of metal, shaped into cylinders, and separated by an oxide layer. A ceramic capacitor has no polarity. Ceramic (film) capacitors are made by layering conductor sheets which alternate with ceramic material. In some instances, ceramic capacitors are disc shaped, but they may be made in other shapes.

In the design depicted in FIG. 2 that eliminates the use of electrolytic capacitors, the capacitance value is reduced to just a few micro farads, because the bidirectional converter filters out most of the output ripple. The capacitance requirement of the designs consistent with that depicted in FIG. 2 is only a few micro farads. This capacitance requirement can be realized by capacitor types, such as ceramic capacitors or film capacitors, and thus eliminate electrolytic capacitors. Hence, the output capacitor 65 of the design depicted in FIG. 2 may be a ceramic capacitor or a film capacitor.

The bidirectional converter 68 generates an AC output that is almost opposite to the actual output ripple of the converter, and hence eliminates most of the ripple content. In some embodiments, the bidirectional converter 68 can be implemented by a floating capacitor full-bridge ripple cancellation converter topology. One of the windings of the transformer from the switching converter 63 provides the required power and polarity information for the bidirectional converter. This topology uses 4 switches in full bridge configuration to generate the AC output. The Inductor and capacitor at the output of this full bridge converter does wave shaping and couples the AC output that is in opposite polarity to the ripple to the output capacitor 65. The bidirectional converter 68 can be used in single stage power conversion or two stage LED conversion topology.

In some embodiments, each of the drivers 50*a*, 50*b* may have a lifetime of greater than 100,000 hours at 85° C. The drivers 50*a*, 50*b* may have a max power output of 96 W. The drivers 50*a*, 50*b* may have a power factor of 0.98 for 12 Vac or 0.96 for 220 Vac.

In one example, each of the drivers 50*a*, 50*b* may have an adjustable output current ranging from 45 mA to 700 mA, a full power current ranges from 450 mA to 700 mA, an input voltage ranges from 90-305 Vac, and output voltage ranging from 74-213 Vdc. In another example, each of the drivers 50*a*, 50*b* may have an adjustable output current ranging from 70 mA to 1050 mA, a full power current ranges from 700 mA to 1050 mA, an input voltage ranges from 90-305 Vac, and output voltage ranging from 48-137 Vdc. In yet another example, each of the drivers 50*a*, 50*b* may have an adjustable output current ranging from 140 mA to 2100, a full power current ranges from 1400 mA to 2100 mA, an input voltage ranges from 90-305 Vac, and output voltage ranging from 24-69 Vdc.

As noted, in some embodiments, each of the first and second drivers 50*a*, 50*b* do not include an electrolytic capacitor. However, embodiments have been contemplated in which at least one of the first and second drivers 50*a*, 50*b* may include one or more electrolytic capacitors.

In some embodiments, the first and second drivers 50*a*, 50*b* have a low output ripple current. For example, a suitable ripple current for some standards like CEC Title 24 is less than 30%. In another example, the first and second drivers 50*a*, 50*b* may each have a ripple current of 10% or less. In some other examples, the ripple current for each of the first and second drivers 50*a*, 50*b* may be equal to 1%, 2%, 3%, 4%, 5%, 6%, 7%, 8%, 9% or 10%, or any range of values including one of the aforementioned values as the bottom of the range, and one of the aforementioned values as the top of the range. For example, the ripple current may range from 1% to 10%.

Referring to FIG. 1, the dimmer control 10 may be a 0V to 10V (0-10V) dimming controller. The 0-10V lighting control signal is a DC voltage that varies between zero and ten volts. The controlled lighting should scale its output so that at 10 V, the controlled light should be at 100% of its potential output, and at 0 V it should at the lowest possible dimming level. In some embodiments, the dimming switch includes a slide from the lowest possible diming level to the highest possible lighting potential.

Referring to FIG. 1, both of the first and second drivers 50*a*, 50*b* are connected to the same 0V to 10V (0-10V) signal of the dimmer control 10. The line and neutral output (line identified by reference number 11) of the 0V to 10V (0-10V) dimmer control 10 is connected to the relay block control 25. The AC input of both drivers 50*a*, 50*b* is also connected to the relay block control 25. The AC input for the first driver 50*a* is identified by reference number 51. The AC input for the second driver 50*b* is identified by reference number 52. Similarly, both the driver outputs for each of the first and second drivers 50*a*, 50*b* are connected to the relay block control 25. The first driver output for the first driver 50*a* is identified by reference number 53. The second driver output for the second driver 50*b* is identified by reference number 54.

Figure 3:
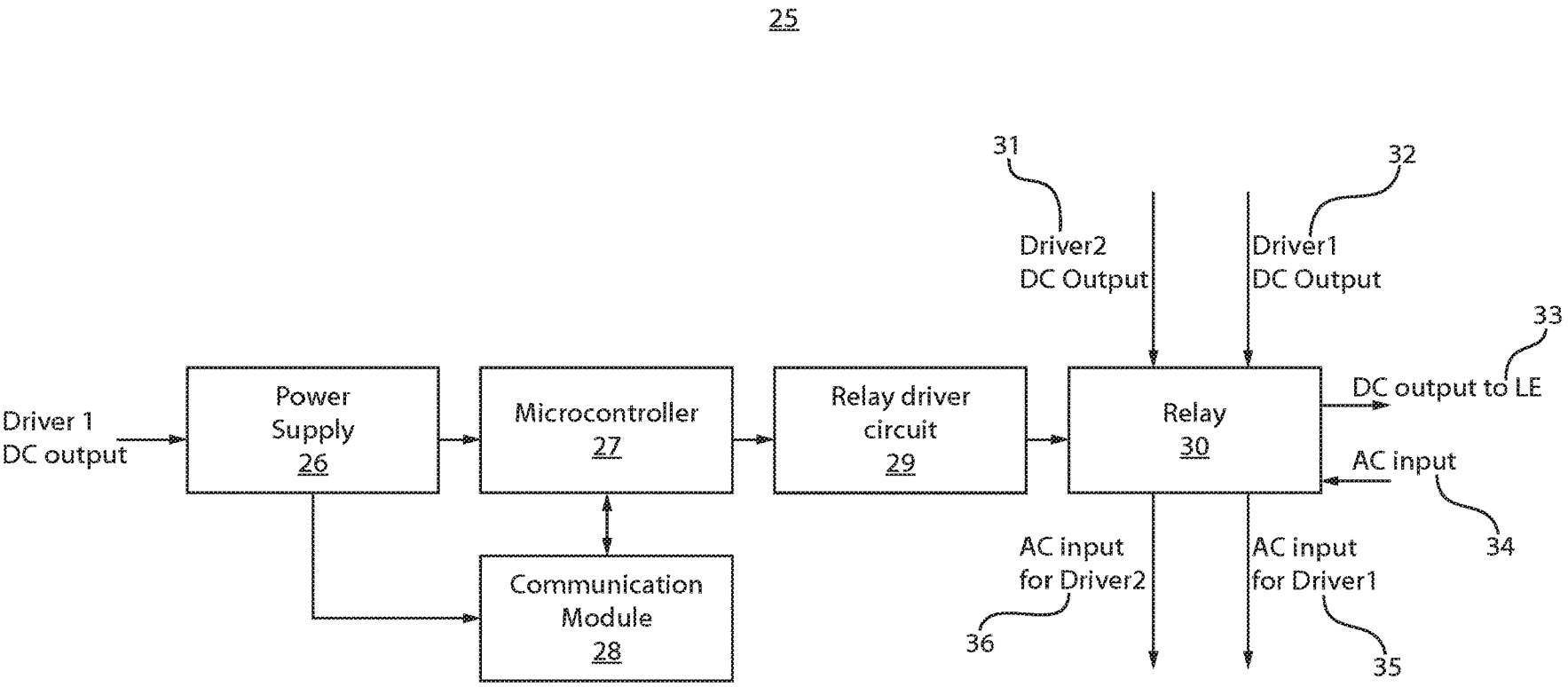
FIG. 3 is a block diagram of the relay control and communications block employed with the driver electronics depicted in FIG. 1, in accordance with one embodiment of the present disclosure.

Referring to FIG. 3, the relay control block 25 may include a power supply 26, microcontroller 27, communications module 28, relay driver circuit 29 and relay 30. The relay driver circuit 29 provides the drive current capability required to power the coil of the relay. The power supply 26 of the relay control block 25 is electrically connected with the direct current (DC) output of the first driver 50*a*.

The relay 30 of the relay control block 25 includes an input (identified by reference number 32) for the DC output of the first driver 50*a*, and an input (identified by reference number 31) for the DC output of the second driver 50*b*. The relay 30 of the relay control block 25 also includes an AC input 34. The AC input 34 is the AC line voltage input. This is directly applied to the relay control box 25 if the dimmer is not used. It is applied through the dimmer if the dimmer is used. The relay 30 for the relay control block 25 also includes a number of outputs. For example, the relay 30 includes an input (identified by reference number 35) that provides the AC input for the first driver 50*a*; and the relay 30 includes an input (identified by reference number 36) that provides the AC input for the second driver 50*b*. The relay 30 also includes a direct current (DC) output 34 to the light engine 15.

Referring to FIGS. 1 and 3, the relay control block 25 uses a timing device to determine the elapsed time. While many types of the timing devices may be used, the microcontroller 27 can provide this function. A microcontroller 27 is a compact integrated circuit designed to govern a specific operation in an embedded system. In some embodiments, the microcontroller 27 includes a processor, memory and input/output (I/O) peripherals on a single chip. The microcontroller 27 may include a module controller for controlling switching between the first and second drivers 50*a*, 50*b*. More specifically, in response to the elapsed time, the microcontroller can actuate switching through the relay driver circuit 29 to the relay 30, in which the relay 30 can send power to the light engine 15. A given module controller may host one or more lighting control modules and may be programmed or otherwise configured to output one or more control signals that may be utilized in controlling the operation of the drivers 50*a*, 50*b* and the light engine 15. In accordance with some embodiments, the module(s) of a given module controller can be implemented in any suitable standard, custom, or proprietary programming language, such as, for example, C, C++, objective C, JavaScript, or any other suitable instruction set, as will be apparent in light of this disclosure. The module(s) of a given module controller can be encoded, for example, on a machine-readable medium that, when executed by a processor, carries out the functionality of lamp/luminaire 100, in part or in whole. The computer-readable medium may be, for example, a hard drive, a compact disk, a memory stick, a server, or any suitable non-transitory computer or computing device memory that includes executable instructions, or a plurality or combination of such memories. Some embodiments can be implemented, for instance, with gate-level logic, an application-specific integrated circuit (ASIC) or chip set, or other such purpose-built logic. Some embodiments of the module controller can be implemented with a microcontroller having input/output capability (e.g., inputs for receiving user inputs; outputs for directing other components) and a number of embedded routines for carrying out device functionality. In a more general sense, the functional modules of a given module controller can be implemented in any one, or combination, of hardware, software, and firmware, as desired for a given target application or end-use.

In some embodiments, when the elapsed time designed by the timing device, e.g., microcontroller 27, is passed, the timing device generates an output that drives the relay through a relay driver circuit 29 and powers the relay coil 30. The relay driver circuit 29 provides the required drive current for the relay coils to operate reliably.

In some embodiments, when the relay 30 is not powered, the first driver 50*a* ("driver 1") is connected to the alternating current (AC) input 35 to the relay 30, and the first driver 50*a* is connected to the light engine 15. The first driver 50*a* is connected to the relay 30 by the input (identified by reference number 32) for the DC output of the first driver 50*a* to the relay 30, and the relay 30 is connected to the light engine 15 through the direct current (DC) output 33 from the relay 30 to the light engine 15.

In some embodiments, when the relay 30 is powered, the second driver 50*b* ("driver 2") is connected to the alternating current (AC) input 36 to the relay 30, and the second driver 50*b* is connected to the light engine 15. The second driver 50*b* is connected to the relay 30 by the input (identified by reference number 31) for the DC output of the second driver 50*b* to the relay 30, and the relay 30 is connected to the light engine 15 through the direct current (DC) output 33 from the relay 30 to the light engine 15.

The elapsed time is the criteria by which the microcontroller 27 of the relay control and communications block 25 switches between the drivers 50*a*, 50*b* for powering the light engine 15. The elapsed time can be set to different values in discrete steps. In some embodiments, the elapsed time is controlled by a multi-position switch or is continuously varied by a trimpot in the relay switching block 25. Trimmer potentiometers are small variable resistors which are used in circuits for tuning and (re)calibration. The trimpot may be mounted on a printed circuit board. The material that can be used as the resistive track of the trimpot may be either carbon composition or cermet. The elapsed time can be set by the manufacturer (which may also be the user). The elapsed time can be set through the switch or the trimpot.

The elapsed time determines how long each driver is on, e.g., how long the first driver 50*a* will be on ("ON"), and how long the second driver 50*b* will be on ("ON"). In some embodiments, the first driver 50*a* is not turned on ("ON") at the same time that the second driver 50*b* is turned on ("ON"). When the second driver 50*b* is turned on ("ON"), the first driver 50*a* is turned off ("OFF"). In some embodiments, the second driver 50*b* is not turned on ("ON") at the same time that the first driver 50*a* is turned on ("ON"). When the first driver 50*a* is turned on ("ON"), the second driver 50*b* is turned off ("OFF"). In some embodiments, the first and second driver 50*a*, 50*b* are never turned on ("ON") at the same time. In some embodiments, the first and second drivers 50*a*, 50*b* may be on at the same time for less than a second, i.e., one second ("1 second") or less.

In one example, the drives 50*a*, 50*b* will take turn every year, and switch between them to power the light engine 15. In one instance, if the elapsed time is set to one year ("1 year"), then the first driver 50*a* ("driver 1") will be on ("ON") for one year. In this example, immediately upon the elapse of that time, i.e., the elapsed time of one year, the second driver 50*b* ("driver 2") is turned on ("ON") and connected to the light engine 15. When the second driver 50*b* is turned on ("ON") and connected to the light engine 15, the first driver 50*a* is turned off ("OFF"). The transition time between the first and second drivers 50*a*, 50*b* during switching to independently power the light engine 15 can range from tens of milliseconds to hundreds of milliseconds. For example, the transition time may be equal to 10 ms (milliseconds), 25 ms, 50 ms, 75 ms, 100 ms, 150 ms, 200 ms, 250 ms, 300 ms, 350 ms, 400 ms, 450 ms and 500 ms, as well as any range of values including one of the aforementioned values as the lower limit of the range, and one of the aforementioned values as the upper limit of the range. In some examples, the transition time is determined by the start up time of the drivers, e.g., first and second drivers 50*a*, 50*b*.

In some embodiments, each driver is effectively on ("ON") for only half of its life in the fixture as they switch the operating time between the two drivers 50*a*, 50*b*, and hence the fixture can last much longer than the life specified for a single driver. For example, if the driver 50*a*, 50*b* is specified for an operating life of 10 years, the driver scheme that is provided herein, which includes the relay control and communications block 25, can extend the life of the fixture for 15 years, or more.

In some embodiments, the microcontroller circuit 27 will measure different timing parameters, such as how long each driver, e.g., each of the first and second driver 50*a*, 50*b*, is powered up, and when to switch the relay 30 and consequently the driver, e.g., switch drivers 50*a*, 50*b* between ON and OFF, based on the time interval set for switching.

Referring to FIGS. 1 and 3, in some embodiments, the relay control and communications block 25 may include a communications port 28. In some embodiments, through the communications port 28 it can be possible to introduce power measurements and determine a weighted average of the power delivered by each driver 50*a*, 50*b*, and change the switching time, where necessary. The communications port 28 may provide for connectivity by wireless communication, like Bluetooth, Wi-Fi and ZigBee. For example, the communications port 28 can provide that the relay control and communications block 25 receive/send signals, e.g., commands, to a user terminal device, which can be provided by a phone, a tablet or even voice control device like Alexa™ and Google™ home. In some embodiments, it can be possible to generate end of life indications for the light assembly including the relay control and communications block 25 based on the operating duration of the drivers 50*a*, 50*b*. This can help a user of the light assembly to replace the fixture before it breaks down. In some embodiments, a user can input the switching interval into the relay control and communications block 25 through the communications interface, e.g., communications port 28.

In one embodiment, the communications port 28 includes a module that provides the necessary wireless interface to the luminaire, such as WiFi or Bluetooth or Bluetooth Mesh.

Referring to FIG. 3, in some embodiments, the relay control block 25 may also include a power supply 26, e.g., low voltage power supply. In some embodiments, the power supply 26 can generate the required power for the relay control block 25, the driver circuit, e.g., first and second drivers 50*a*, 50*b*, and the timer circuit, e.g., the microcontroller 27.

In some embodiments, the power supply 26 is powered by the DC output of the driver, e.g., first driver 50*a* or second driver 50*b*, so that the power supply can be easily designated without any electrolytic capacitors. The power supply 26 can be operated from a line voltage of 120V or 277V. In some embodiments, the power supply 26 has enough hold up time to last the loss of output power during the transition between the first and second drivers 50*a*, 50*b* (i.e., the transition being the switching of ON and OFF between the first and second drivers 50*a*, 50*b* so that one of the drivers is "ON" and one of the drivers is "OFF".

In one example, the power supply 26 operates from direct current (DC) output of the first driver 50*a* ("driver 1"), which is powered on ("ON") by default. The power supply provides required voltage for the electronics associated with relay control and communication, i.e., for powering the relay control and communication block 25 depicted in FIG. 3.

The driver scheme described herein can be applied to any input voltage, such as 120V, 277V, 347V or 480V.

While two drivers 50*a*, 50*b* are depicted in FIG. 1, the present disclosure is not limited to only this example, as it is possible to have more than two drivers integrated into designs consistent with the present disclosure. For example, more than two drivers may be employed if there is a cost and performance benefit to achieve extra-long lifetime by employing greater than two drivers, e.g., three or greater drivers, and switching between the plurality of drivers during operation.

In some embodiments, in place of the electro-mechanical relay, e.g., relay 30, of the relay control block 25, a solid state relay may be used or switching devices, e.g., metal oxide semiconductor field effect transistor (MOSFET), may be used.

Figure 4:
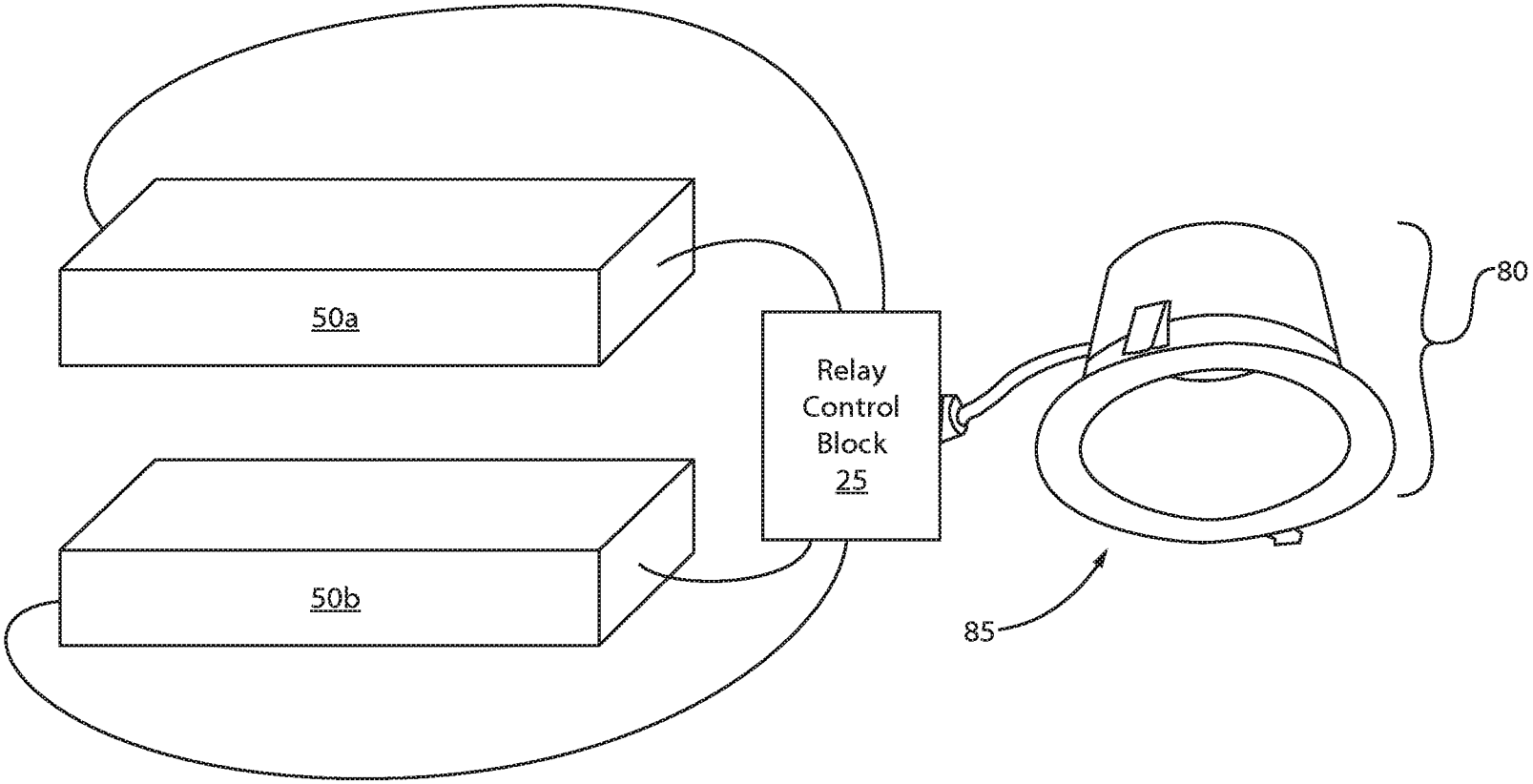
FIG. 4 is an exploded perspective view of a downlight fixture containing a light emitting diode (LED) light source and being powered by the driver electronics described with reference to FIGS. 1-3.
Figure 5:
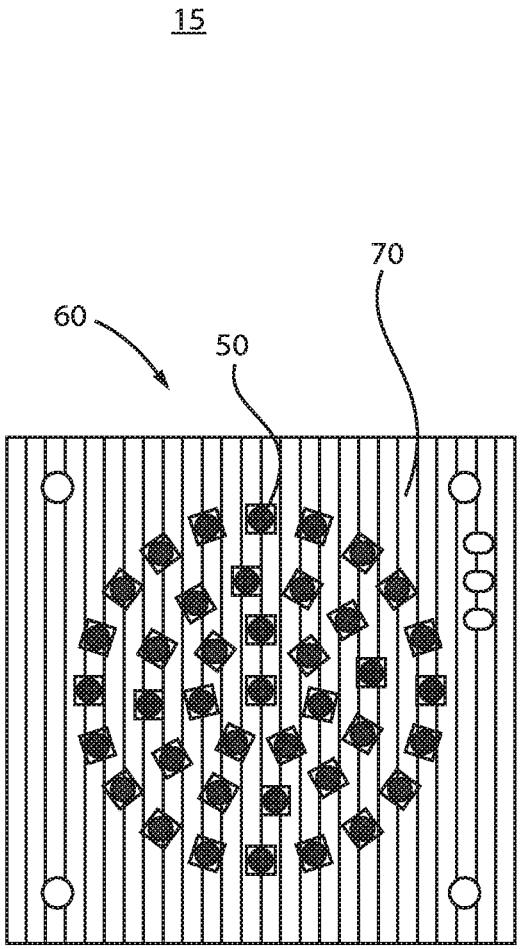
FIG. 5 is a top down view of one embodiment of a light emitting diode (LED) light engine including at least one string of light emitting diodes (LEDs) as used in the housing of the downlight fixture designs depicted in FIG. 4.
Figure 6:
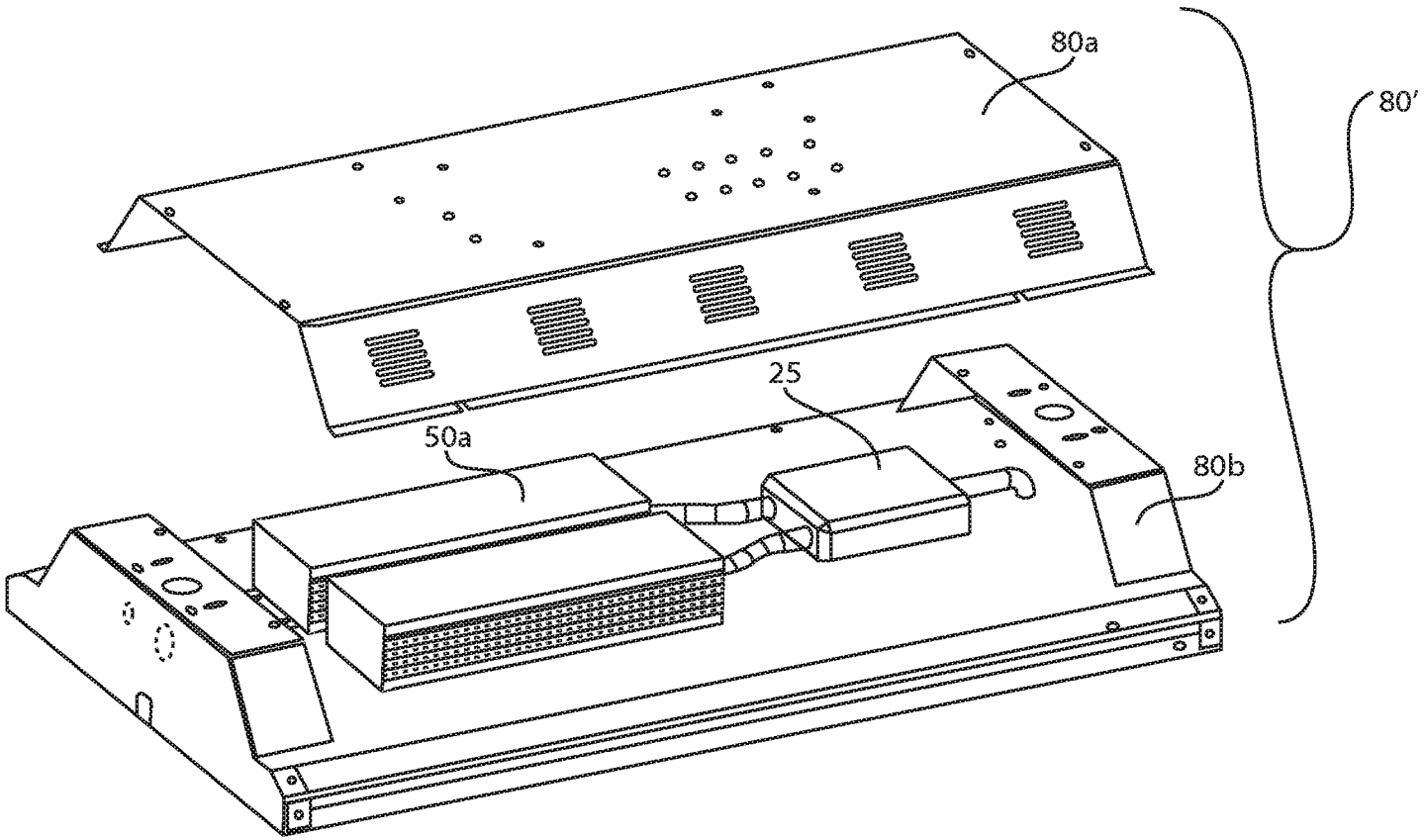
FIG. 6 is a perspective view of a highbay light fixture containing a light emitting diode (LED) light source for being powered by the driver electronics described with reference to FIGS. 1-3.
Figure 7:
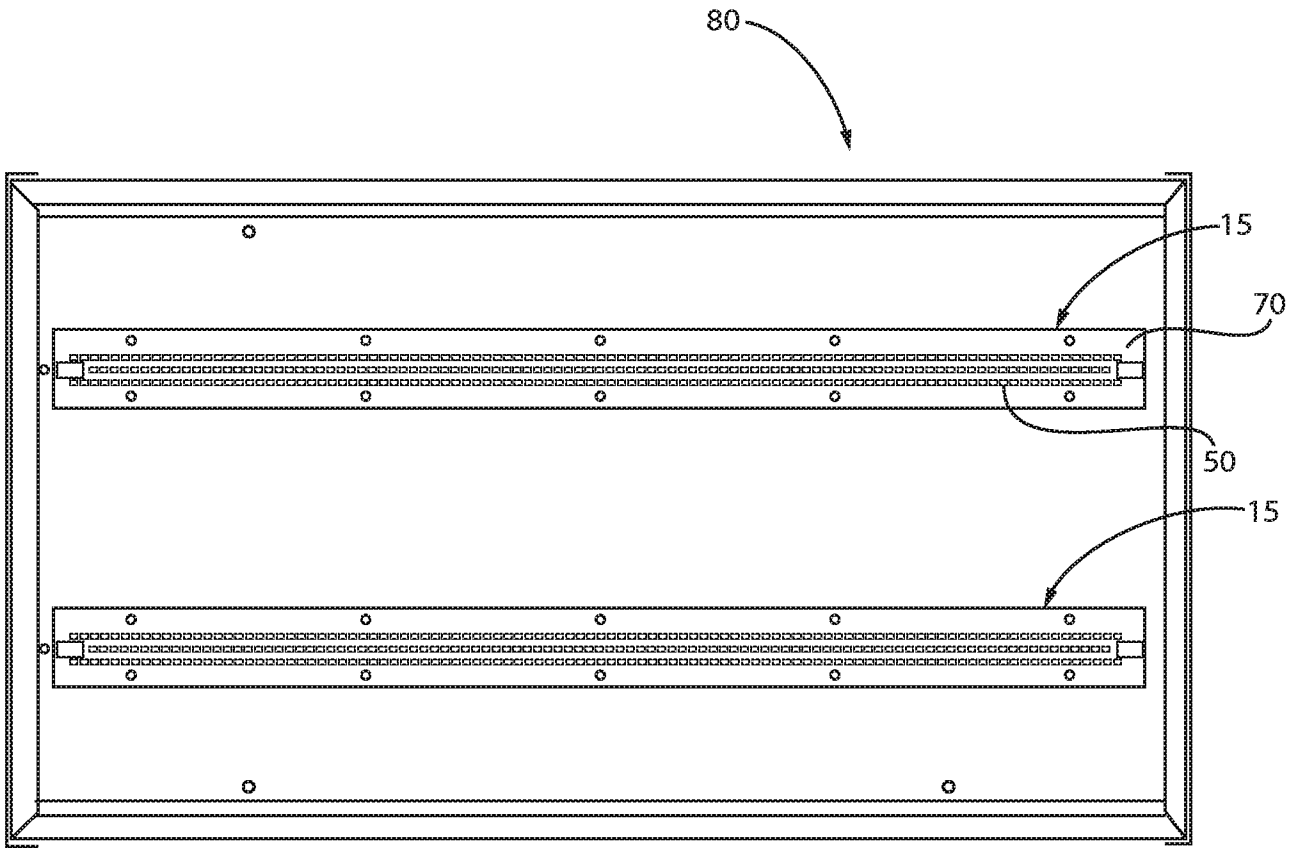
FIG. 7 is a bottom up view of a highbay light fixture depicting a light engine including light emitting diodes (LEDs).

FIGS. 4-7 illustrates some embodiments of the lamp/luminaire geometries and light engines that can be used with the driver electronics 100 that are depicted in FIGS. 1-3. It is noted that the lamp/luminaire geometries provide only some examples of the types of lamps/luminaires that are suitable for use with the driver electronics, and it is not intended that the scope of the claims be limited by these examples. FIG. 4 depicts one example of a downlight. FIG. 5 illustrates one example of a light emitting diode (LED) light engine that can be used with the downlight that is depicted in FIG. 4. FIGS. 6 and 7 illustrate one embodiment of a highbay fixture.

FIG. 4 depicts a light engine housing 80 having a downlight geometry. The light engine housing 80 may include a light engine 15 (as described with reference to FIG. 1) having a plurality of light emitting diodes (LEDs) strings that are powered by the driver electronics scheme 100 that is depicted in FIGS. 1-3. FIG. 6 illustrates a light engine housing 80' having a highbay geometry. The light engine housing 80' includes a body 80*a*' and a cover 80*b*'. The light engine 15 for the highbay type lamp/luminaire is depicted in FIG. 7

The light engine 15 within the light engine housing 80, 80' is in electrical communication with the relay control block 25, in which the relay control block 25 is in electrical communication with the drivers 50*a*, 50*b* as described above with reference to FIG. 1. Although not depicted in FIGS. 4, 6 and 7, the light engine 15 within the light engine housing 80, 80' can be controlled with a dimmer switch 10. The dimmer switch 10 and its connectivity to the drivers 50*a*, 50*b*, and the relay control block 25 is described above with reference to FIGS. 1-3.

The light engine housing 80 that is depicted in FIG. 4 is only one example of a lamp engine form factor that can be used with the driver electronics 100 that are described herein. The light engine housing 80 may be used for interior lighting, e.g., interior residential lighting, or may be used for exterior lighting. For example, the light engine housing 80 may be used for recessed down lights. In other examples, the light engine housing 80 can be employed in flood lights. In other examples, the light engine housing 80 can be used in horticultural lights. The driver electronics 100 that are described herein can be used with any form factor light engine, and the driver electronics 100 can be used for any lighting application, such as the highbay fixtures depicted in FIGS. 6 and 7. As described above, the driver electronics 100 include two drivers 50*a*, 50*b* each having a service life of 10 years, and each driver 50*a*, 50*b* having a filter design that limits the percent flicker to be on the order of 30% or lower.

In one example, the light engine housing 80, 80' that contains the light emitting diode (LED) light engine 15 may be composed of a metal, such as aluminum (Al), which provides for heat dissipation of any heat produced by the light engine. In some embodiments, to provide for increased heat dissipation, a plurality of ridges or fin structures may be integrated into the aluminum housing, e.g., light engine housing 80, 80'. In some embodiments, the light engine housing 80 may also be composed of a plastic, such a polycarbonate. For the embodiments consistent with FIG. 4, the construction of the light engine housing 80 may fall into one of four categories for downlights that are recognized in North America. For example, the housing may be constructed for IC or "insulation contact" rated new construction housings are attached to the ceiling supports before the ceiling surface is installed. If the area above the ceiling is accessible these fixtures may also be installed from within the attic space. IC housings are typically required wherever insulation will be in direct contact with the housing. Non-IC rated new construction housings are used in the same situations as the IC rated new construction housings, only they require that there be no contact with insulation and at least 3 in (7.6 cm) spacing from insulation. These housings are typically rated up to 150 watts. IC rated remodel housings are used in existing ceilings where insulation will be present and in contact with the fixture. Non-IC rated remodel housings are used for existing ceilings where, no insulation is present. Non-IC rated remodel housings require that there be no contact with insulation and at least 3 in (7.6 cm) spacing from insulation. Sloped-ceiling housings are available for both insulated and non-insulated ceilings that are vaulted. It is noted that the light engine housing 80 of the downlight of the present disclosure may meet be designed to meet the requirements of any of the aforementioned standards.

In some embodiments, when the light engine housing 80 is for an interior light having a downlight geometry, the light engine housing 80 can include trim 85 that is selected to increase the aesthetic appearance of the lamp. In some embodiments, the trim 85 may be a baffle that is black or white in color. In some embodiments, the trim 85 is made to absorb extra light and create a crisp architectural appearance. There are cone trims which produce a low-brightness aperture. In some embodiment, the trim 85 may be a multiplier that is designed to control the omnidirectional light from the light engine. Lens trim is designed to provide a diffused light and protect the lamp. Lensed trims are normally found in wet locations. The luminous trims combine the diffused quality of lensed trim but with an open down light component. Adjustable trim allows for the adjustment of the light whether it is eyeball style, which protrudes from the trim or gimbal ring style, which adjusts inside the recess.

FIG. 5 is a top down view of a light emitting diode (LED) light engine 15 including at least one string of light emitting diodes (LEDs) as used in the light engine housing 85 of the lamp designs depicted in FIG. 4. The light engine (also referred to as light source) is positioned within the light engine housing 80 and orientated to emit light in a direction through opening of the light engine housing 80 at which the trim 85 is positioned. The light engine produces light from solid state emitters. FIG. 7 is a bottom up view of a highbay light fixture depicting a light engine 15 including light emitting diodes (LEDs). The light engine 15 depicted in FIG. 7 is similar to the light engine depicted in FIG. 5, wherein differences in the geometry of the light engine 15 are to match the geometry of the light engine's application to a downlight as depicted in FIG. 4 or a highbay fixture as depicted in FIG. 7.

The term "solid state" refers to light emitted by solid-state electroluminescence, as opposed to incandescent bulbs (which use thermal radiation) or fluorescent tubes, which use a low pressure Hg discharge. Compared to incandescent lighting, solid state lighting creates visible light with reduced heat generation and less energy dissipation. Some examples of solid state light emitters that are suitable for the methods and structures described herein include inorganic semiconductor light-emitting diodes (LEDs), organic light-emitting diodes (OLED), polymer light-emitting diodes (PLED) or combinations thereof. Although the following description describes an embodiment in which the solid state light emitters are provided by light emitting diodes, any of the aforementioned solid state light emitters may be substituted for the LEDs.

Referring to FIG. 5, in some embodiments, the light source 15 (also referred to as light engine 15) for the downlight is provided by plurality of LEDs 50 that can be mounted to the circuit board 70 by solder, a snap-fit connection, or other engagement mechanisms. In some examples, the LEDs 50 are provided by a plurality of surface mount device (SMD) light emitting diodes (LED). The light engine 15 depicted in FIG. 7 also includes a plurality of LEDs identified by reference number 50 mounted to a circuit board 70.

The circuit board 70 for the light engine 15 may be composed of a metal core printed circuit board (MCPB). MCPCB uses a thermally conductive dielectric layer to bond circuit layer with base metal (Aluminum or Copper). In some embodiments, the MCPCB use either Al or Cu or a mixture of special alloys as the base material to conduct heat away efficiently from the LEDs thereby keeping them cool to maintain high efficacy.

It is noted that the number of LEDs 50 on the printed circuit board 70 may vary. For example, the number of LEDs 50 may range from 5 LEDs to 70 LEDs. In another example, the number of LEDs 50 may range from 35 LEDs to 45 LEDs. It is noted that the above examples are provided for illustrative purposes only and are not intended to limit the present disclosure, as any number of LEDs 50 may be present the printed circuit board 70. In some other examples, the number of LEDs 50 may be equal to 5, 10, 15, 20, 25, 30, 35, 40, 45, 50, 55, 60, 65 and 70, as well as any range of LEDs 50 with one of the aforementioned examples as a lower limit to the range, and one of the aforementioned examples as an upper limit to the range.

The LEDs 50 may be arranged as strings on the printed circuit board 70. When referring to a "string" of LEDs it is meant that each of the LEDs in the string are illuminated at the same time in response to an energizing act, such as the application of electricity from the driving electronics, e.g., driver, in the downlight 100. The LEDs 50 in a string of LEDs are electrically connected for this purpose. For example, when a string of LEDs 50 is energized for illumination, all the LEDs in the string are illuminated. Further, in some embodiments, illuminating the first string of LEDs 50 does not illuminate the LEDs in the second string of LEDs 50, and vice versa, as they are independently energized by the driving electronics, and not electrically connected. It is also noted that the same LED may be shared by more than one string.

The LEDs 50 of the light engine 15 may also be selected to be capable of adjusting the light intensity/dimming of the light they emit. In some examples, dimming or light intensity may be measured using lumen (LM). In some embodiments, the dimming or light intensity adjustment of the LEDs 50 can provide for adjusting lighting between 100 LM to 2000 LM. In another embodiment, dimming or light intensity adjustment of the LEDs 50 can provide for adjusting lighting between 500 LM to 1750 LM. In yet another embodiment, the dimming or light intensity adjustment of the LEDs 50 can provide for adjusting lighting between 700 LM to 15000 LM.

Referring to FIGS. 6 and 7, in some embodiments, when the lamp/luminaire is a highbay fixture, the dimming or light intensity adjustment of the LEDs 50 can provide for adjusting lighting between 4000 LM to 58000 LM.

In some embodiments, the LED light engines 15 for the downlight may provide the that downlight be an SMD (Surface Mount Diode) downlight and/or a COB (Chip on Board) downlights. In some embodiments, the LEDs 50 may be selected to be SMD type emitters, in which the SMDs are more efficient than COBs because the light source produces higher lumens per watt, which means that they produce more light with a lower wattage. In some embodiments, the SMD type LEDs 50 can produce a wider beam of light which is spread over a greater area when compared to light engines of COB type LEDs. This means that less material is needed for the heat sink, which in turn means that they are more economical. SMD downlights can be covered with a frosted reflector which hides the LED chip array and spreads the light evenly. SMD downlights can produce a wide spread of light. In some example, the wide beam angle of the light emitted from SMD downlights means they can be suitable for larger rooms like living rooms, bedrooms, kitchens and bathrooms.

A Chip On Board (COB) LED Downlight consists of a single LED chip, mounted on the downlight, compared to an array of LED's like an SMD. COB LEDs are basically multiple LED chips (typically nine or more) bonded directly to a substrate by the manufacturer to form a single module. The ceramic/aluminum substrate of COB LEDs also acts as a higher efficiency heat transfer medium when coupled to an external heatsink, further lowering the overall operating temperature of the assembly. Since the individual LEDs used in a COB are chips, the chips can be mounted such that they take up less space and the highest potential of the LED chips can be obtained. When the COB LED package is energized, it appears more like a lighting panel than multiple individual lights as would be the case when using several SMD LEDs mounted closely together. In some embodiments, because the single cluster of LED's 50 are mounted in one point, they can require greater cooling, so a heat sink, usually made of aluminum, may be mounted to dissipate the heat.

A light engine of COB type LEDs 50 can provide a more focused light and with the use of reflectors, the light beam can be more controlled when compared to a light engine that is composed of SMD LEDs. Chrome reflectors surrounding the diode can be replaced and set at different angles to make the light beam narrower or wider. Due to the narrow beam and with the use of reflectors that are usually clear, COB lights generate crisper and cleaner as there is no frosting on the lenses, which cuts down the clarity of the LED light. Due to the clear lenses, more light can penetrate further which means they perform well in rooms with high ceilings.

It is noted that the above description of the light emitting diodes (LEDs) 50 is provided for illustrative purposes only and is not intended to limit the present disclosure. For example, In some embodiments, other light sources may either be substituted for the LEDs 50, or used in combination with the LEDs 50, such as organic light-emitting diodes (OLEDs), a polymer light-emitting diode (PLED), and/or a combination of any one or more thereof.

The above embodiments and examples are given above to illustrate the scope and spirit of the present invention. These embodiments and examples will make apparent, to those of ordinary skill in the art, other embodiments and examples. These other embodiments and examples are within the contemplation of the present invention. Therefore, the present invention should be limited only by the appended claims.

What is claimed is:

1. A luminaire comprising:

driver electronics includes at least two drivers;

a control relay block in electrical contact with a driver output from each of the at least two drivers; and a light engine connected to the driver electronics through the control relay block, wherein the control relay block controls the at least two drivers so that only one of the drivers is powering the light engine at a time, the control relay block includes a microcontroller for setting an elapsed time that said controls the at least two drivers so that only one of the drivers is powering the light engine at a time.

2. The luminaire of claim 1, wherein the light engine includes light emitters that are solid state light emitters.

3. The luminaire of claim 1, wherein the solid state light emitters are selected from the group consisting of semiconductor light-emitting diodes (LEDs), organic light-emitting diodes (OLED), polymer light-emitting diodes (PLED) and combinations thereof.

4. The luminaire of claim 1, wherein the control relay block comprises connections for receiving signal from a dimmer switch.

5. The luminaire of claim 4, wherein the dimmer switch sends a 0-10V dimmer signal to the control relay block.

6. The luminaire of claim 5, wherein each of the at least two drivers are connected to a signal from the dimmer switch.

7. The luminaire of claim 6, wherein a line and neutral output from the dimmer switch is electrically connected to the relay control block.

8. The luminaire of claim 1, wherein when the elapsed time is passed the microcontroller generates an output that powers a relay in the control relay block through a driver circuit.

9. The luminaire of claim 8, further comprising the relay of the control relay block not being powered so that a first driver of the at least two drivers is connected to an AC input and is connected to the light engine, wherein a second driver is not connected to the light engine; or the relay of the control relay block is powered so that the second driver of the at least two drivers is connected to the AC input and is connected to the light engine, and the first driver is not connected to the light engine.

10. The luminaire of claim 1, wherein the at least two drivers do not include electrolytic capacitors.

11. An illumination method comprising:

connecting at least two drivers to a light engine through a relay control block; and switching between a first of the least two drivers to a second of the at least two drivers, wherein said switching between the two drivers is controlled by the relay control block, and the switching between the two drivers is at a time interval that provides that only one driver powers the light engine at a time, wherein the control relay block includes a microcontroller for setting an elapsed time that said controls the at least two drivers so that only one of the drivers is powering the light engine at a time.

12. The illumination method of claim 11, wherein the light engine includes light emitters that are solid state light emitters selected from the group consisting of semiconductor light-emitting diodes (LEDs), organic light-emitting diodes (OLED), polymer light-emitting diodes (PLED) and combinations thereof.

13. The illumination method of claim 11, wherein the control relay block comprises connections for receiving signal from a dimmer switch.

14. The illumination method of claim 11, wherein a dimmer switch sends a 0-10V dimmer signal to the control relay block.

15. The illumination method of claim 14, wherein each of the at least two drivers are connected to a signal from the dimmer switch.

16. The illumination method of claim 15, wherein a line and neutral output from the dimmer switch is electrically connected to the relay control block.

17. The illumination method of claim 11, wherein when the elapsed time is passed the microcontroller generates an output that powers a relay in the control relay block through a driver circuit.

18. The illumination method of claim 17, further comprising the relay of the control relay block not being powered so that a first driver of the at least two drivers is connected to an AC input and is connected to the light engine, wherein a second driver is not connected to the light engine; or the relay of the control relay block is powered so that the second driver of the at least two drivers is connected to the AC input and is connected to the light engine, and the first driver is not connected to the light engine.

* * * * *